United States Patent [19]

Itoh, deceased et al.

[11] Patent Number: 4,633,868

[45] Date of Patent: Jan. 6, 1987

[54] CLOSED CIRCUIT TYPE RESPIRATOR

[75] Inventors: Kazu Itoh, deceased, late of Tokyo; Akira Itoh, legal representative, Komae, both of Japan

[73] Assignee: Itoh Seiki Kabushiki Kaisha, Tokyo, Japan

[21] Appl. No.: 736,718

[22] Filed: May 22, 1985

[30] Foreign Application Priority Data

Jun. 4, 1984 [JP] Japan ..... 59-83167[U]

[51] Int. Cl.[4] ..... A62B 7/04

[52] U.S. Cl. ..... 128/204.26; 128/205.24

[58] Field of Search ..... 128/204.26, 204.28, 128/205.12, 204.22, 205.24

[56] References Cited

U.S. PATENT DOCUMENTS 2,456,130 11/1948 Lambertsen ..... 128/205.12

2,892,456 6/1959 Seeler ..... 128/204.26

FOREIGN PATENT DOCUMENTS 1538953 8/1968 France ..... 128/204.28

*Primary Examiner*—Henry J. Recla

*Attorney, Agent, or Firm*—Diller, Ramik & Wight

[57] ABSTRACT

A closed-circuit type respirator includes an oxygen enriching valve provided in an exhalation system of the respirator, preferably at the lower front end of a respirator mask. This oxygen enriching valve comprises a housing having a passage communicating to the exhalation system and a passage communicating to the atmosphere, a first valve which is provided in the passage communicating to the exhalation system and opens only when pressurized for exhalation and a second valve which is provided in the passage communicating to the atmosphere and is opened for a desired period of time by an external force such as manual operation so that the space inside the housing communicates with the atmosphere. By manually or otherwise opening the second valve of the oxygen enriching valve whenever necessary and making a few deep breathings, the exhaled air is discharged in the atmosphere, reducing the pressure in the circulation system and effecting automatic supply of oxygen, whereby insufficiency of oxygen supply can be avoided.

5 Claims, 3 Drawing Figures

CLOSED CIRCUIT TYPE RESPIRATOR

BACKGROUND OF THE INVENTION

This invention relates to a closed-circuit type respirator, and more particularly to a closed-circuit type respirator capable of preventing a risk of insufficient supply of oxygen in the respiratory system at static condition.

FIG. 2 shows the construction of a prior art closed-circuit respirator. In the respirator, the air from a mask a passes through an exhalation valve and an exhalation pipe b into a cleaning canister c where carbon dioxide in the exhaled air is absorbed, and the remaining air enters a respirator bag d and passes through an inhalation pipe and an inhalation valve e to enter the mask a again to be inhaled into the lung responding to each breathing. Oxygen in an amount corresponding to that consumed in the lung is automatically supplied into the inhalation pipe e from a pressurized oxygen container f via an automatic demand valve g. Since breathing becomes difficult due to insufficient oxygen in the respirator if the amount of oxygen consumed exceeds the amount supplied, a bypass valve h is provided in the respirator to arbitrarily supply oxygen by manual operation. On the other hand, if the amount of oxygen supplied exceeds the amount consumed, the pressure in the respirator increases and causes the user to feel pressed. Therefore an automatic relief valve i is provided to automatically release excessive air to restore the pressure to an optimum level. Thus in the prior art, a respirator is either of a type in which a bypass valve for oxygen is opened at the start of use to let a certain amount of oxygen directly into the circulation system to inflate a breathing bag to the fullest extent to thereby let out the air accumulated in the system, or of a type in which a constant flow of oxygen in a given amount is supplied in the circulation system together with the air flow caused by breathing to thereby fill the system with 100% oxygen in due time. Either of these types aims at constantly providing 100% oxygen for inhalation.

The applicant of the present invention, on the other hand, proposed in Utility Model Registration No. 1380741, patent application No. Sho 57-219488 and Utility Model application No. Sho 59-003128 to re-utilize as much air in the circulation system as possible without discharging it outside and to maintain oxygen concentration in the system approximately below 45%. In this way excess in oxygen amount can be avoided even if a closed-circuit respirator is used over a long period of time under atmospheric or higher pressure, and the portion of gas discharged during use will contain less than 45% of oxygen and over 55% of nitrogen instead of 100% oxygen, whereby a more economical device which is also effective in preventing any risks can be obtained.

However, in said system, the minimum oxygen concentration drops to the marginal value of 21% required for normal respiration and oxygen insufficiency to a certain extent may arise depending on the static condition.

Since an appropriate portable oximeter is not available at present, an oximeter is not generally attached to a closed-circuit respirator, and it is necessary to check against any risk of oxygen insufficiency which may occur under static condition as a safety precaution.

SUMMARY OF THE INVENTION

The present invention aims at providing a closed-circuit respirator in which a risk of oxygen insufficiency under static condition is avoided. Whereas a prior art respirator as those two described in the foregoing adopts a system to pass oxygen directly into the circulation system, the present invention aims at reducing the pressure in the circulation system by discharging a portion of exhaled air into the atmosphere, to thereby introduce oxygen corresponding to said discharged exhaled air into the closed-circuit respirator via an automatic demand valve, and to indirectly increase oxygen concentration in the respirator. In order to attain the above mentioned object, the closed-circuit respirator according to the present invention is characterized in that there is provided in an exhalation system of the respirator (i.e., a section of the respirator where exhaled air passes), preferably at the lower front end of a respirator mask, an oxygen enriching valve comprising a housing having a passage communicating to the exhalation system and a passage communicating to the atmosphere, a first valve which is provided in the passage communicating to the exhalation system and opens only when pressurized for exhalation and a second valve which is provided in the passage communicating to the atmosphere and is opened for a desired period of time by an external force such as manual operation so that the space inside the housing communicates with the atmosphere. By manually or otherwise opening the second valve of said oxygen enriching valve whenever necessary and making a few deep breathings, the exhaled air is discharged in the atmosphere, reducing the pressure in the circulation system and effecting automatic supply of oxygen. In this way, insufficiency of oxygen supply can be completely avoided. According to experiments, it is confirmed that oxygen concentration under static condition is maintained substantially constant at any desired value approximately from over 27% to 100% by using the respirator of the present invention.

In addition, a closed-circuit respirator of the present invention can be adapted for an open-circuit type respirator for emergency medicine to wash out toxic gas which has entered the lung as well as to enable such inhalation of highly concentrated oxygen.

BRIEF DESCRIPTION OF THE DRAWINGS

In the attached drawings.

DESCRIPTION OF A PREFERRED EMBODIMENT

An embodiment according to this invention will now be described referring to the attached drawing.

Figure 3:
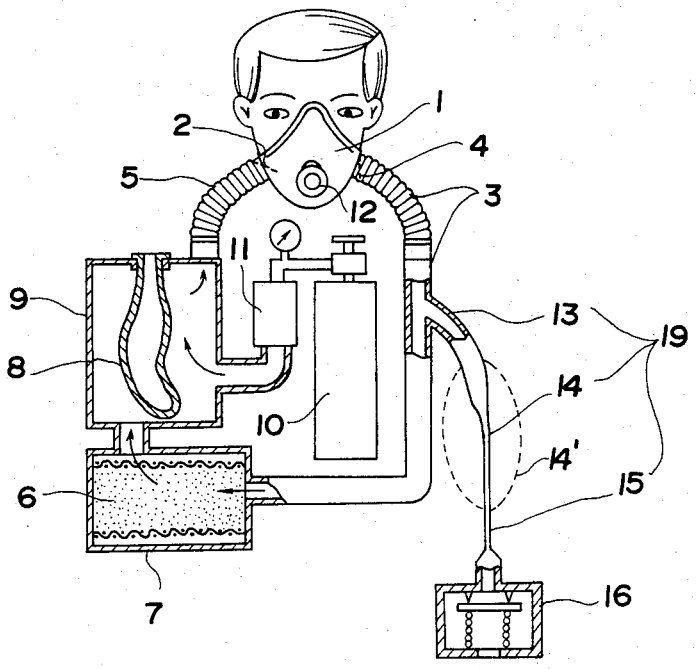
FIG. 3 shows an embodiment of the closed-circuit respirator according to this invention.

FIG. 3 shows an embodiment of the respirator of closed-circuit type according to this invnetion in which the structure described in the Utility Model Application No. Sho 59-3128 filed by the present applicant is employed in parts. In the respirator, an inhalation pipe 5 and an exhalation pipe 3 are connected to a mask 1 via an inhalation valve 2 and an exhalation valve 4. The exhaled air which is discharged through the exhalation pipe 3 is passed through a cleaning canister (carbon dioxide removing device) 7 which is filled with an absorbent (such as $Ca(OH)_2$) 6 to remove carbon dioxide gas, and the cleaned air is passed through a box 9 housing a breathing bag 8, which communicates to open air, to be returned to the inhalation pipe 5. Oxygen is supplied from a compressed oxygen cylinder 10 to the box 9 via a demand valve 11 in an amount corresponding to the removed carbon dioxide.

A branched out pipe 13 is connected to the exhalation pipe 3 and an exhalation bag 14 is connected thereto at the tip thereof. The bag 14 is made of an elastic bag having slight restorability. The bag in its original form contracts itself as shown in solid line 14, but when it is filled with gas by a rapid or deep breathing, it expands to the form indicated by dotted line 14'. When the inflow of gas is suspended, the gas in the bag is recycled into the system via the pipe 13 by the restoring force of the bag. An opening is formed at the tip of the exhalation bag 14. A capillary tube 15 of extremely small diameter is connected to the opening. The exhaled air passage 19 is comprised of the branched out pipe 13, the exhalation bag 14 and the capillary tube 15. At the tip of the capillary tube 15 is connected a static pressure discharge valve 16.

In the pressure existing within the exhalation system, the respiratory dynamic pressure component which is generated by breathing is attenuated and removed through the branched out exhaled air passage so that static pressure component alone reaches the static pressure discharge valve. When the static pressure exceeds a prescribed value, the excess pressure is released outside to prevent excessive increase in the static pressure as well as to maintain the function of the breathing bag at normal condition. The device can therefore prevent excessive increase of the oxygen concentration in the inhaled air.

Figure 1:
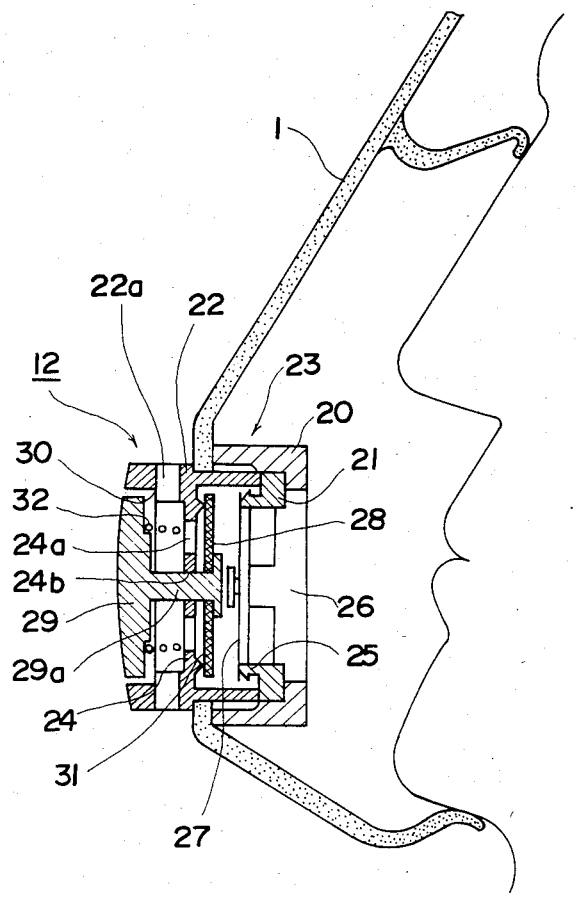
FIG. 1 is a sectional view showing the oxygen enriching valve of the present invention.
Figure 2:
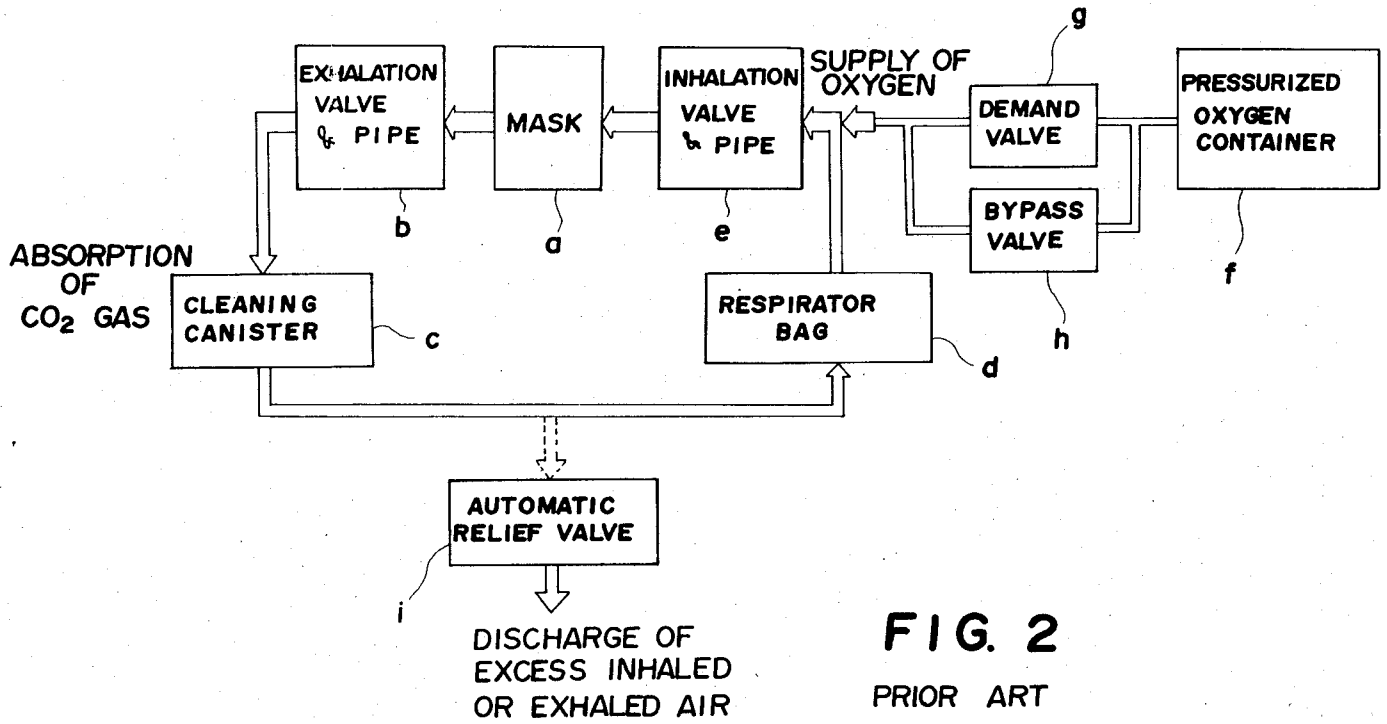
FIG. 2 PRIOR ART
FIG. 2 is a schematic diagram to show the exhaling system of a prior closed-circuit type respirator.

Details of an oxygen enriching valve 12 are shown in FIG. 1. In the present embodiment the oxygen enriching valve 12 is attached to the lower front end of the mask 1. A support ring 20 fixed inside the mask 1, a ring member 21 securely fitted in said ring 20 and a cylinder 22 fixed to said ring member 21 and having open ends on both sides constitute a housing 23 of the oxygen enriching valve 12. The space in the center defined by the support ring 20 and the ring member 21 forms a passage 26 communicating to the exhalation system (FIG. 3) of the circulation system. A disk-like member 24 is formed on the cylinder 22 and breathers or openings 24*a* and 22*a* are respectively bored in the disk-like member 24 and the outer sidewall of the cylinder 22. These breathers 24*a* and 22*a* each form a passage communicating to the atmosphere.

A disk-like check valve 27 which extends to the passage 26 communicating to the exhalation system is provided outside an annular valve seat 25 in such a manner as to be seated, when not applied with exhaled air, on said valve seat 25 formed at the outer end (toward the atmosphere) of the ring member 21. The check valve 27 is made of a flexible material such as rubber or plastic so that when exhaled air is applied its outer circumference is flexed to let the air outside. A disk-like manual valve 28 made of rigid plastic, etc. and extending to the breather 24*a* is provided inside the disk-like member 24. A push button 29 is fixed to the manual valve 28 and a shaft 29*a* of the push button 29 is slidably inserted in an opening 24*b* bored in the disk-like member 24. A coil spring 32 is interposed between the push button 29 and the disk-like member 24 and the manual valve 28 is pressed against an annular valve seat 31 formed inside the disk-like member 24. Thus the manual valve 28 opens only when the push button 29 is pushed.

The operation of the above embodiment will now be described.

A user first wears the closed-circuit respirator of the present invention, and places the mask 1 to fit. After confirming that the mask is securely attached, the user breathes deeply two or three times while pushing the button 29 of the oxygen enriching valve 12 until it touches a step portion 30 formed in the cylinder 22. The exhaled air passes through the check valve 27, the interval between the manual valve 28 which is open at the time and the valve seat 31, and is discharged to outside via breathers 24*a* and 22*a*. The check valve 27 functions to prevent air for inhalation from entering the mask 1 from outside. As a result, the pressure in the circulation system is inevitably reduced and the demand valve 11 is actuated to introduce oxygen into the exhalation system with a hissing sound, thereby increasing the oxygen concentration. Actuation of the demand valve 11 can be confirmed by the hissing sound. As the push button 29 is released, the manual valve 28 is automatically closed by the restoring force of the coil spring 32 to immediately block the exhaled air from outside. By completing the above operation at the start of use, fall in oxygen concentration seldom occurs in the closed-circuit respirator during use even if air circulation is suspended. However, if required during use, oxygen concentration in the circulation system can easily be increased by repeating the above operation.

By maintaining the resistance of the oxygen enriching valve sufficiently smaller than the resistance of the exhalation system, or by coupling the oxygen enriching valve 12 and the exhalation valve 4 to cause the exhalation valve to close simultaneously with the actuation of the enriching valve or to cause the resistance of the exhalation pipe to increase, the exhaled air is directly discharged to outside through the oxygen enriching valve instead of entering the exhalation pipe. Therefore the closed-circuit type respirator acts as an open-type oxygen respirator while the oxygen enriching valve is actuated as in the above. During such operation, the exhaled air is discharged outside at each breathing and in turn oxygen is introduced in the exhalation pipe to rapidly increase oxygen concentration in the exhaled air. The concentration thus increased is maintained thereafter. Thus the closed-circuit respirator of the present invention can be employed as an oxygen inspirator for emergencies to tentatively wash out substance such as toxic gas in the lung as well as to effect inhalation of oxygen in high concentration. When the emergency treatment is completed, the device immediately and automatically restores its original function as the closed-circuit type respirator for use over a long period of time by releasing the push button of the enriching valve.

Although the oxygen enriching valve 12 is opened/-closed manually by means of the push button 29 in the preferred embodiment, the operation of the valve is not limited to manual. An oxygen concentration sensor may be attached to the closed-circuit type respirator of the present invention to automatically open the oxygen enriching valve to supply oxygen into the system when the oxygen concentration detected by the sensor decreases below a predetermined value. The position of the oxygen enriching valve 12 is not limited to that indicated in the above embodiment. It can be provided at any arbitrary position in the exhalation system extending e.g. from the mask 1 to the inhalation box 9 as in the above described embodiment. When it is provided at the position as in the above embodiment, the valve can be opened by pressing the button 29 against a wall, a desk and the like without using hand, which is quite convenient when both hands are otherwise occupied.

What is claimed is:

1. In a closed-circuit type respirator including a face mask, an inhalation conduit communicating with said face mask, and exhalation conduit communicating with said face mask, a first check valve provided in said inhalation conduit, a second check valve provided in said exhalation conduit; said face mask, exhalation conduit and second check valve constituting at least a part of an exhalation system which is a section of the respirator where exhaled air passes, and an oxygen demand system connected to said inhalation conduit and supplying oxygen automatically when the pressure in the respirator is reduced to a predetermined level characterized in that said respirator comprises an oxygen enriching valve provided in said exhalation system, said oxygen enriching valve including a housing opening to said exhalation system on one side and to atmosphere on the other side, first valve means provided within said housing on the side opening to said exhalation system and being capable of opening only when pressurized by exhaled air to let the air from said exhalation system into said housing, second valve means provided within said housing on the side opening to the atmosphere and being capable of opening for a predetermined period of time by applying an external force for communicating the inside of said housing to atmosphere, the air in said exhalation system being let out through said first and second valve means when said second valve means is opened and the pressure in the respirator thereby being reduced to the predetermined level at which oxygen is automatically supplied.

2. A closed-type respirator as defined in claim 1 wherein said oxygen enriching valve is provided at the lower front end of said face mask.

3. A closed-type respirator as defined in claim 1 wherein said first valve means comprises a check valve exposed to said exhalation system and closing the side of said housing opening to said exhalation system when said check valve is not pressurized by exhaled air and a valve seat provided on said housing.

4. A closed-circuit type respirator as defined in claim 1 wherein said second valve means is manually operated.

5. A closed-circuit type respirator as defined in claim 4 wherein said second valve means comprises a disk-like manual valve exposed to atmosphere, a push button fixed to said manual valve, a valve seat for said manual valve provided on said housing and spring means interposed between said push button and said disk-like member.

* * * * *